US005301636A

United States Patent [19]

Nakamura

[11] Patent Number: 5,301,636

[45] Date of Patent: Apr. 12, 1994

[54] VALVE OPERATING MECHANISM OF INTERNAL COMBUSTION ENGINE

[75] Inventor: Makoto Nakamura, Yokosuka, Japan

[73] Assignee: Nissan Motor Co., Ltd., Japan

[21] Appl. No.: 92,108

[22] Filed: Jul. 16, 1993

[30] Foreign Application Priority Data

Sep. 17, 1992 [JP] Japan ..... 4-248237

[51] Int. Cl.[5] ..... F01K 1/34

[52] U.S. Cl. ..... 123/90.16; 123/198 F; 123/308; 123/432

[58] Field of Search ..... 123/90.15, 90.16, 90.17, 123/90.22, 90.39, 90.4, 90.44, 198 F, 308, 432

[56] References Cited

U.S. PATENT DOCUMENTS

| | | | |
|---|---|---|---|
| 4,556,025 | 12/1985 | Morita | 123/198 F |
| 4,765,289 | 8/1988 | Masuda et al. | 123/90.16 |
| 4,770,137 | 9/1988 | Okabe et al. | 123/198 F |
| 4,907,550 | 3/1990 | Inoue et al. | 123/90.16 |
| 4,962,732 | 10/1990 | Inoue et al. | 123/90.16 |
| 5,046,462 | 9/1991 | Matayoshi et al. | 123/90.16 |
| 5,085,182 | 2/1992 | Nakamura et al. | 123/90.16 |
| 5,090,364 | 2/1992 | McCarroll et al. | 123/90.16 |
| 5,159,905 | 11/1992 | Sugiuchi et al. | 123/90.16 |
| 5,193,496 | 3/1993 | Kruger | 123/90.16 |
| 5,239,952 | 8/1993 | Morita | 123/90.16 |

OTHER PUBLICATIONS

"Development of High-Efficiency Gasoline Engine With Variable Valve Lift and Timing System", Automotive Technique vol. 45, No. 88, pp. 93-98, (1991).

*Primary Examiner*—E. Rollins Cross
*Assistant Examiner*—Weilun Lo
*Attorney, Agent, or Firm*—Lowe, Price, LeBlanc & Becker

[57] ABSTRACT

On a main rocker arm, there is arranged a pivotal sub-rocker arm. A rocker arm coupling mechanism is employed which, under a given condition of an associated engine, couples tightly the main rocker arm and the sub-rocker arm to cause the main rocker arm to pivot in accordance with rotation of a higher lift cam. First and second tappet members are carried by the main rocker arm to actuate two intake or exhaust valves of the engine in response to the pivoting movement of the main rocker arm. The second tappet member is loosely connected to the main rocker arm so that, under a certain condition, the second tappet member fails to transmit the pivoting movement of the main rocker arm to the associated valve. A tappet locking mechanism is further employed which, under a given operation condition of the engine, locks the second tappet member to the main rocker arm thereby to ensure the transmission of the pivoting movement of the main rocker arm to the associated valve.

14 Claims, 5 Drawing Sheets

| | I | II | III | IV |
|---|---|---|---|---|
| OPERATION MODE | LOWER SPEED LOWER LOAD | LOWER SPEED HIGHER LOAD | MIDDLE SPEED | HIGHER SPEED |
| INTAKE VALVES IN OPERATION | ONLY VALVE 8 OPERATES WITH SMALLER LIFT   | ONLY VALVE 8 OPERATES WITH LARGER LIFT   | BOTH VALVES 8&9 OPERATE WITH SMALLER LIFT   | BOTH VALVES 8&9 OPERATE WITH LARGER LIFT   |
| A/F RATIO | LEAN | SOMEWHAT LERN | STOICHIOMETRIC OR RICH | STOICHIOMETRIC OR RICH |

VALVE OPERATING MECHANISM OF INTERNAL COMBUSTION ENGINE

BACKGROUND OF THE INVENTION

1. Field of the Invention

The present invention relates in general to valve operating mechanisms of an internal combustion engine, and more particularly to valve operating mechanisms for use in an internal combustion engine which has at least two intake or exhaust valves for each cylinder. More specifically, the present invention is concerned with valve operating mechanisms of a type which has a plurality of cams for actuating the valves, the cams being automatically switched in accordance with the operation condition of the engine.

2. Description of the Prior Art

As is known, in internal combustion engines, there is a type in which, for improving the output performance of the engine, two intake valves are provided for each cylinder. One of the engines of this type is shown in Automotive Journal named "Automotive Technique" Volume 45 No. 8 which was issued in 1991 from "Automotive Technology Society". In this prior art engine, under lower speed operation necessitating only a small amount of intake air, one of the two intake valves is kept closed to assuredly create a swirl in the associated combustion chamber. With this, stable combustion is obtained in the combustion chamber under such lower speed operation.

In order to clarify the task of the present invention, a valve operating mechanism for the above-mentioned prior art engine will be outlined with reference to FIG. 10 of the accompanying drawings.

As is seen from the drawing, the valve operating mechanism generally comprises a cam shaft 73 having two cams 71 and 72 mounted thereon and a hydraulically actuated rocker arm unit 77. The profile of the cam 72 is so formed as to induce a smaller valve lift. The rocker arm unit 77 includes a main rocker arm 75, a sub-rocker arm 76 and a hydraulic piston 74. Upon higher speed operation of the engine, a hydraulic pressure is applied to the piston 74 to move the same rightward in the drawing thereby uniting the two rocker arms 75 and 76. Thus, thereafter, the two associated intake valves (not shown) are forced to operate in accordance with the rotation of the cam 71. While, under lower speed operation of the engine, the piston 74 keeps the illustrated position permitting the two rocker arms 75 and 76 to operate independently in accordance with rotation of the respective cams 71 and 72. Thus, under this lower speed operation of the engine, the two intake valves are operated in accordance with the cams 71 and 72 respectively. In this case, because the cam 72 is so formed as to induce a smaller valve lift as mentioned hereinabove, one intake valve controlled by the cam 72 is kept substantially closed, so that a swirl is produced in the combustion chamber. That is, under such condition, the intake valve controlled by the cam 72 substantially takes a rest.

In general, a swirl produced in the combustion chamber is greatly affected by the flow speed of the intake air introduced into the combustion chamber through the intake ports. Thus, when, under lower speed and lower load operation necessitating only a small amount of intake air, the lift of the other intake valve (viz., the intake valve which is not subjected to the rest) is controlled relatively small, the flow speed of the intake air through this intake valve is increased and thus higher or stronger swirl is obtained in the combustion chamber.

However, if this measure is simply applied to the prior art valve mechanism of FIG. 10, that is, if the cam profile of the cam 71 is so formed as to induce a smaller valve lift, the air intake efficiency at the higher speed operation is greatly lowered due to the reduced lift of the two intake valves, which means lowering in output power of the engine. While, when, for the purpose of increasing the air intake efficiency at the higher speed operation, the cam 71 is so formed as to induce a larger cam lift, it becomes impossible to obtain a satisfied swirl at the lower speed operation of the engine.

That is, in the above-mentioned conventional valve operating mechanism, satisfied intake efficiency at the higher speed operation and satisfied swirl at the lower speed operation are not obtained at the same time.

SUMMARY OF THE INVENTION

It is therefore an object of the present invention to provide a valve operating mechanism of internal combustion engine, which reconcile satisfied intake efficiency in the higher speed operation and satisfied swirl in the combustion chamber in the lower speed operation.

According to the present invention, there is provided a valve operating mechanism for use in an internal combustion engine having at least two intake or exhaust valves for each cylinder. The valve operating mechanism comprises first and second cams provided about a common cam shaft; a main rocker arm which pivots about a rocker shaft in accordance with a rotation of the first cam; a sub-rocker arm which pivots relative to the main rocker arm in accordance with a rotation of the second cam; a rocker arm coupling mechanism which, under a given operation condition of the engine, couples tightly the main rocker arm and the sub-rocker arm to cause the main rocker a=to pivot in accordance with the rotation of the second cam; first and second tappet means held by the main rocker arm to press tops of the two valves in response to the pivoting movement of the main rocker arm, the second tappet means being loosely connected to the main rocker arm so that under a certain condition, the second tappet means fails to transmit the pivoting movement of the main rocker arm to the associated valve; and a tappet locking mechanism which, under a given operation condition of the engine, locks the second tappet means to the main rocker arm thereby to ensure the transmission of the pivoting movement of the main rocker arm to the associated valve.

DETAILED DESCRIPTION OF THE INVENTION

Referring to FIGS. 1 to 7 of the accompanying drawings, there is shown a valve operating mechanism of the present invention. The mechanism is shown to be practically applied to an internal combustion engine which has two intake valves for each cylinder. That is, the valve operating mechanism, which will be described in detail hereinafter, is arranged to operate the two intake valves of the engine.

Figure 1:
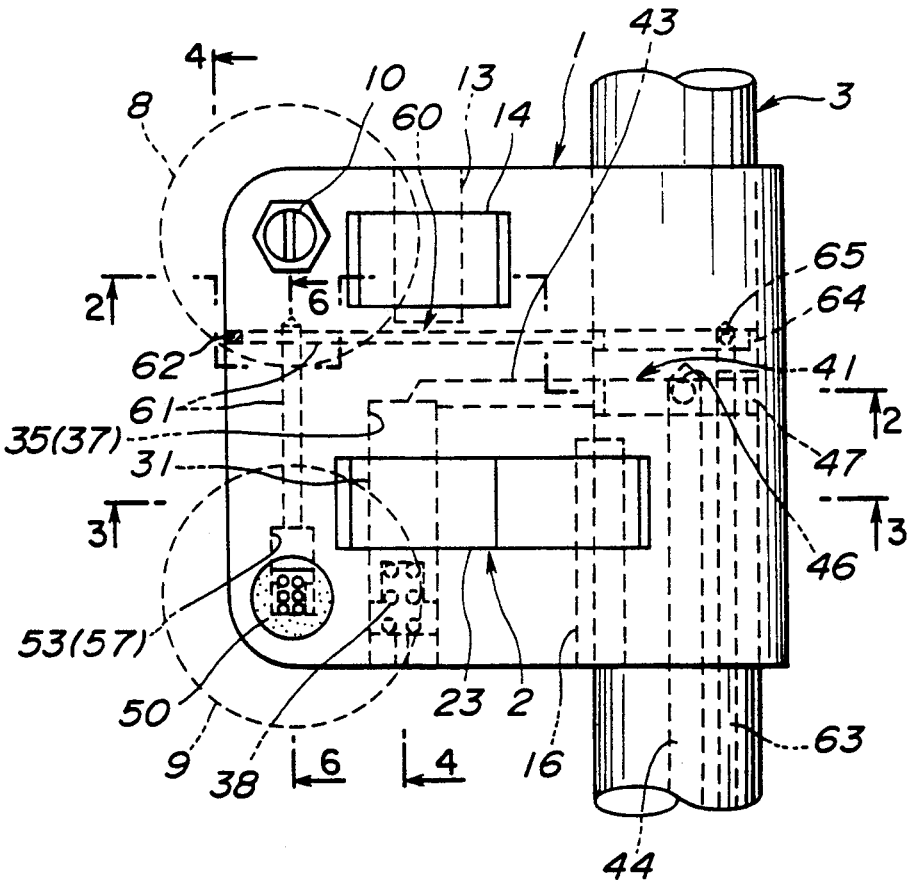
FIG. 1 is a plan view of a valve operating mechanism according to the present invention.
Figure 2:
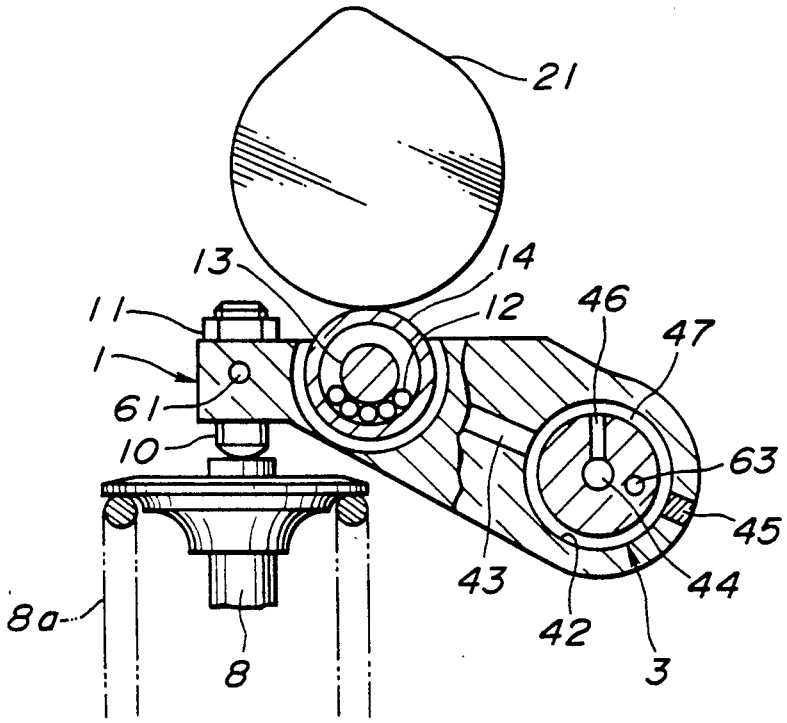
FIG. 2 is a sectional view taken along the line A—A of FIG. 1.
Figure 6:
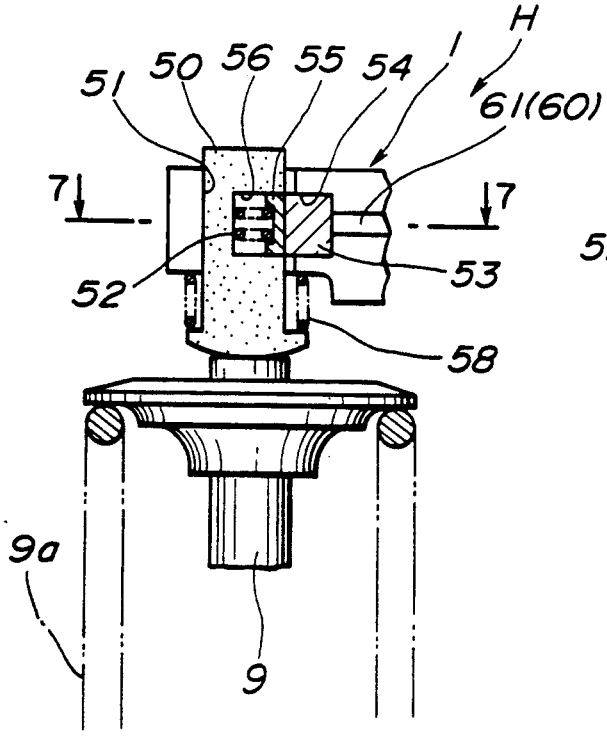
FIG. 6 is a sectional view taken along the line D—D of FIG. 1.

As is understood from FIGS. 1, 2 and 6, the associated internal combustion engine has two intake valves 8 and 9 for each cylinder. Each intake valve 8 or 9 has a spring 8a or 9a for being biased in a direction to close an associated intake opening (not shown) of the combustion chamber. Although not shown in the drawings, the engine has of course one or two exhaust valves for each cylinder.

As may be understood from FIG. 1, in order to operate both the two intake valves 8 and 9, a single main rocker arm 1 is provided. The main rocker arm 1 has a base end pivotally disposed about a main rocker shaft 3 which is supported on a cylinder head (not shown).

As is seen from FIG. 2, the main rocker arm 1 has a roller 14 rotatably mounted thereto. A shaft 13 and a needle bearing 12 are associated with the roller 14 to achieve the rotatable mounting of the roller 14 relative to the main rocker arm 1. The roller 14 is in contact with a first cam 21 whose cam profile is so shaped as to induce a smaller valve lift. For ease of description, the first cam 21 will be referred to as a lower lift cam hereinafter.

As is seen from FIG. 1, the main rocker arm 1 is generally rectangular in shape. As is seen from FIGS. 1 and 3, the main rocker arm 1 has also a sub-rocker arm 2 pivotally mounted thereto. The sub-rocker arm 2 has a base end pivotally disposed about a sub-rocker shaft 16 which is held by the main rocker arm 1. As is understood from FIG. 1, the axis of the shaft 13 for the roller 14 and the axis of the sub-rocker shaft 16 are parallel with each other.

Figure 3:
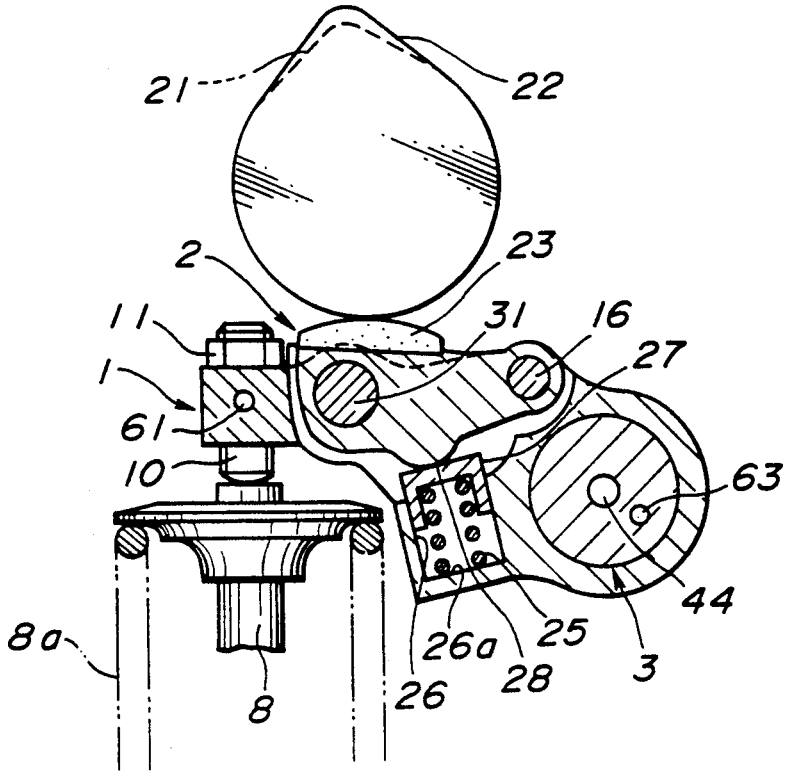
FIG. 3 is a sectional view taken along the line B—B of FIG. 1.

As is seen from FIGS. 1 and 3, the sub-rocker arm 2 has no portions which are in contact with the intake valves 8 and 9. The sub-rocker arm 2 has at its free end part a convexly raised cam follower portion 23 which is in contact with a second cam 22 whose cam profile is so shaped as to induce a larger valve lift. For ease of description, the second cam 22 will be referred to as a higher lift cam hereinafter. It is to be noted that the higher lift cam 22 and the above-mentioned lower lift cam 21 are integrally formed about a common shaft.

As is seen from FIG. 3, below the sub-rocker arm 2, there is arranged a lost-motion spring 25 which biases the cam follower portion 23 to abut against the higher lift cam 22.

As is seen from FIG. 3, the main rocker arm 1 is formed, at a position just below the sub-rocker arm 2, with a cylindrical recess 26 for receiving therein the lost motion spring 25. A lower end of the lost motion spring 25 is seated on a bottom 26a of the cylindrical recess 26, and an upper end of the spring 25 is received in a retainer 27 which is slidably engaged with the cylindrical recess 26. Due to the force of the spring 25, the retainer 27 is forced to abut against a follower portion 28 which is integrally formed on the sub-rocker arm 2.

Figure 4:
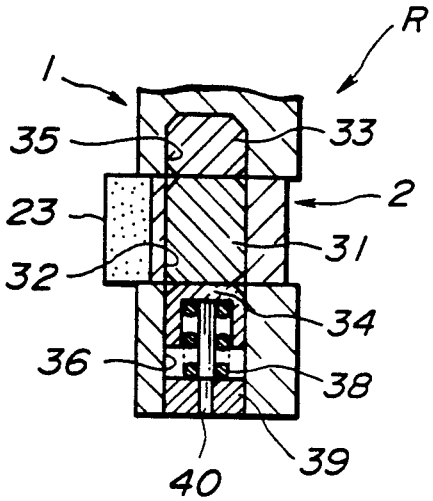
FIG. 4 is a sectional view taken along the line C—C of FIG. 1, showing a rocker arm coupling mechanism in an inoperative condition.
Figure 5:
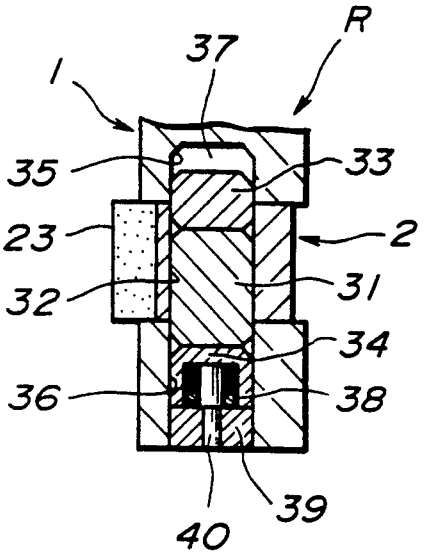
FIG. 5 is a view similar to FIG. 4, but showing an operative condition of the rocker arm coupling mechanism.

In order to selectively couple and uncouple the main rocker arm 1 and the sub-rocker arm 2, a rocker arm coupling mechanism R is employed, which, as will be seen from FIGS. 4 and 5, comprises aligned bores 35 and 36 formed in the main rocker arm 1 and a through bore 32 formed in the sub-rocker arm 2. These three bores 35, 36 and 32 are all equal in diameter. The bores 35 and 36 slidably receive respective plungers 33 and 34 and the bore 32 slidably receives a plunger 31. The plunger 34 is of a hollowed member. As is seen from FIG. 5, the bore 35 of the main rocker arm 1 defines an oil chamber 37 behind the plunger 33, and the other bore 36 of the main rocker arm 1 has a return spring 38 behind the plunger 34. An upper part of the return spring 38 is received in the hollow of the plunger 34, as is best seen from FIG. 4. A plug 39 is fitted in the bore 36, which is formed with an air passage 40 through which the hollow of the plunger 34 is communicated with the outside air.

When the sub-rocker arm 2 takes a given angular position relative to the main rocker arm 1, the through bore of the sub-rocker arm 2 becomes in alignment with the other two aligned bores 35 and 36 of the main rocker arm 1. Thus, as is seen from FIG. 5, when, under this condition, the oil chamber 37 becomes filled with a pressurized fluid, the plunger 33 is partially moved into the through bore 32 and at the same time the plunger 31 is partially moved into the bore 36 against the force of the return spring 38 thereby inducing coupling of the main rocker arm I and the sub-rocker arm 2. Thus, under this coupled condition, the main rocker arm 1 is forced to operate in accordance with the rotation of the higher lift cam 22.

While, when, as is seen from FIG. 4, the pressurized oil is discharged from the oil chamber 37, the plungers 33, 34 and 31 are returned to their original rest positions due to the force of the return spring 38. Thus, the main rocker arm 1 and the sub-rocker arm 2 are uncoupled. Under this uncoupled condition, the pivotal movement of the main rocker arm 1 controlled by the lower lift cam 21 is not suppressed by the sub-rocker arm 2. That is, under this uncoupled condition, the main rocker arm 1 is forced to operate in accordance with the rotation of the lower lift cam 21.

As is seen from FIGS. 1 and 2, from the oil chamber 37 of the main rocker arm 1, there extends an oil passage 41 which comprises a straight passage 43 formed in the main rocker arm 1. The straight passage 43 extends diametrically across a bearing bore 42 for the main rocker shaft 3. As is seen from FIG. 2, an exposed end of the passage 43 is covered with a plug 45. An annular groove 47 is formed about a cylindrical wall of the main rocker shaft 3, which is in communication with both the straight passage 43 and one spurt hole 46 from an oil gallery 44 formed in the main rocker shaft 3. Thus, under a given condition, a pressurized oil is fed to the oil chamber 37 from the oil gallery 44 through the spurt hole 46, the annular groove 47 and the straight passage 43.

As is seen from FIGS. 1 and 2, the main rocker arm 1 has, at its free end near the roller 14, a tappet screw 10 adjustably connected thereto through a connecting nut 11. The lower end of the tappet screw 10 is in contact with a top of a stem portion of the intake valve 8.

While, as is seen from FIGS. 1 and 6, the main rocker arm 1 has, at the free end thereof near the sub-rocker arm 2, another tappet 50 which is movably mounted thereto. The lower end of the tappet 50 is in contact with a top of a stem portion of the other intake valve 9. As is understood from FIG. 7, one side of the tappet 50 is formed with a flat portion for the purpose which will become apparent hereinafter.

Figure 7:
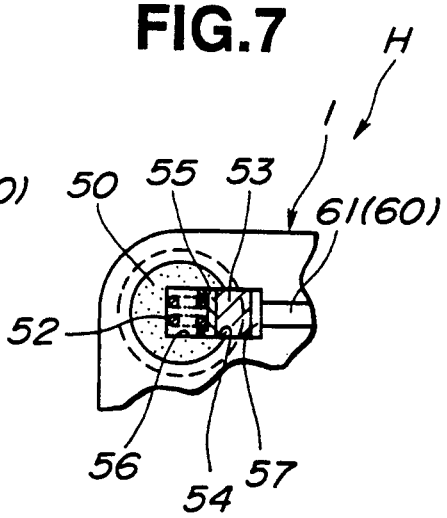
FIG. 7 is a sectional view taken along the line E—E of FIG. 1.

As is seen from FIGS. 6 and 7, the tappet 50 is slidably put in a bore 51 formed in the main rocker arm 1. A return spring 58 is compressed between an enlarged lower end of the tappet 50 and the main rocker arm 1, so that the tappet 50 is biased downward in FIG. 6.

In order to selectively lock and unlock the tappet 50 relative to the main rocker arm 1, a tappet locking mechanism H is employed, which, as is seen from FIGS. 6 and 7, comprises a bore 54 formed in the main locker arm 1 and another bore 56 formed in the tappet 50. The bore 56 is exposed to the flat portion of the tappet 50. These two bores 54 and 56 are equal in diameter. Within the bores 54 and 56, there are slidably received respective plungers 53 and 55. As is seen from FIG. 7, the bore 54 defines an oil chamber 57 behind the plunger 53, and the other bore 56 has a return spring 52 behind the plunger 55. By the spring 52, the plunger 55 is biased outward, that is, toward the other plunger 53.

When the tappet 50 takes a given position relative to the main rocker arm 1, the bore 56 of the tappet 50 becomes in alignment with the other bore 54 of the main rocker arm 1. Thus, as is seen from FIG. 7, when, under this condition, the oil chamber 57 is filled with a pressurized fluid, the plunger 53 is partially put into the bore 56 against the force of the spring 52 thereby inducing a locked engagement of the tappet 50 relative to the main rocker arm 1. Thus, under this locked condition, the tappet 50 and the main rocker arm 1 move like an integral unit.

While, when, as is understood from FIG. 6, the pressurized oil is discharged from the oil chamber 57, the plungers 53 and 55 are returned to their original rest positions due to the force of the return spring 52. Under this condition, the sliding movement of the tappet 50 relative to the main rocker arm 1 is not suppressed. That is, under this condition, the pivoting movement of the main rocker arm 1 makes only idling compression and expansion of the return spring 58 without transferring to the intake valve 9.

As is seen from FIGS. 1 and 7, from the oil chamber 57 of the main rocker arm 1, there extends an oil passage 60 which comprises a generally L-shaped passage 61 formed in the main rocker arm 1. Like the above-mentioned straight passage 43 of the rocker arm coupling mechanism R, the passage 61 extends diametrically across the bearing bore 42 for the main rocker shaft 3. An exposed end of the passage 61 is covered with a plug 62. Another annular groove 64 is formed about the cylindrical wall of main rocker shaft 3, which is in communication with both the passage 61 and another spurt hole 65 from another oil gallery 63 formed in the main rocker shaft 3. As is seen from FIG. 1, the two oil galleries 44 and 63 extend in parallel and axially in the main rocker shaft 3. Thus, under a given condition, a pressurized oil is fed to the oil chamber 57 from the oil gallery 63 through the spurt hole 65, the annular groove 64 and the L-shaped passage 61.

The two oil galleries 44 and 63 are connected through respective control valves (not shown) to an oil pump (not shown) powered by the associated engine. The control valves are controlled by a control unit which uses, as control parameters, engine speed, engine cooling is water temperature, lubricant oil temperature, throttle valve opening degree, air induction pressure of turbocharger (if mounted) and the like. The control unit of this type is shown in for example U.S. Pat. No. 4,962,732 and U.S. Pat. No. 4,907,550. That is, each control valve is arranged to feed the associated oil gallery 44 or 63 with higher or lower oil pressure in accordance with the engine operation condition.

Figure 8:
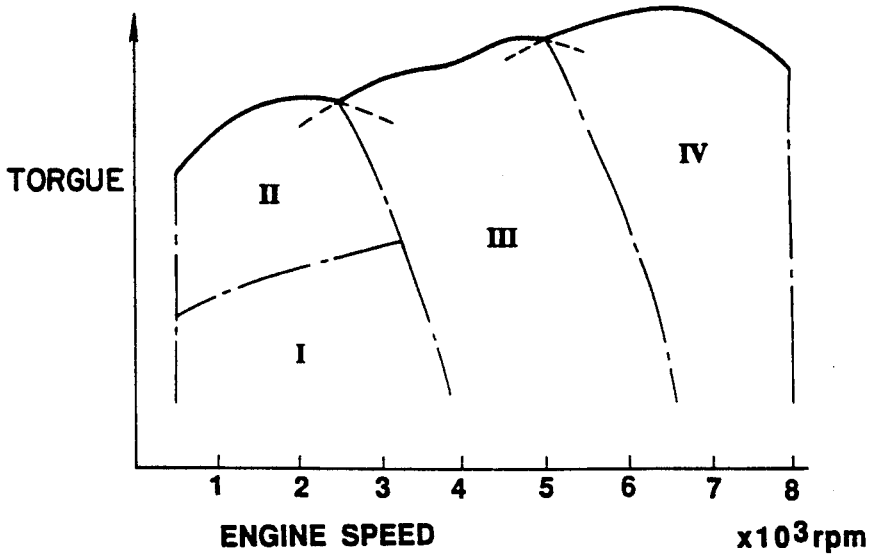
FIG. 8 is a graph showing four controlled conditions with respect to engine speed and torque.
Figure 10:
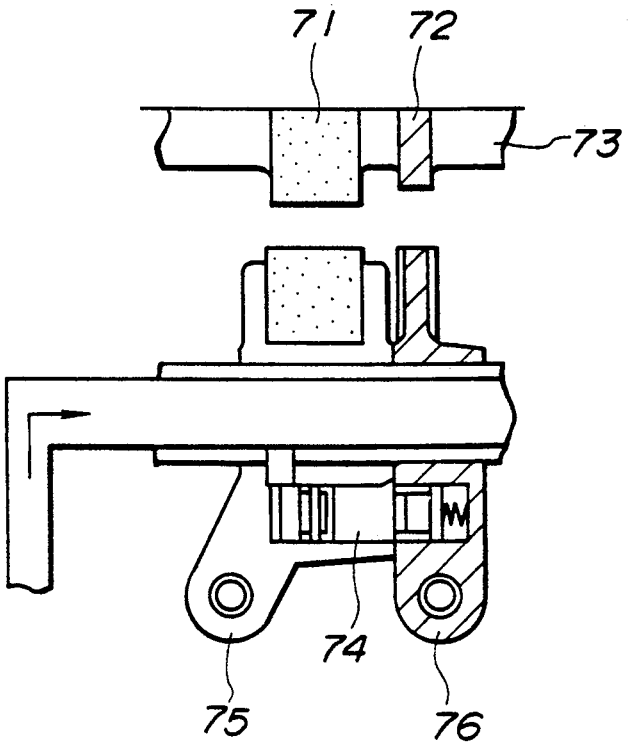
FIG.10 (PRIOR ART)
FIG. 10 is a schematic view of a conventional valve operating mechanism.

In the present invention, as is seen from the graph of FIG. 8, the oil gallery 44 for the rocker arm coupling mechanism R is fed with a predetermined higher oil pressure when the engine is under a lower speed higher load condition (viz., the zone denoted by "II") and under a higher speed (viz., the zone denoted by "IV"), while, the other oil gallery 63 for the tappet locking mechanism H is fed with a predetermined higher oil pressure when the engine is under a middle and higher speed (viz., the zones denoted by "III" and "IV").

In the following, operation of the valve operating mechanism of the invention will be described with reference to the drawings.

For ease of understanding, the description will be commenced with respect to a condition wherein the engine is under a lower speed and lower load condition (viz., the zone denoted by "I" in FIG. 8). Under this light condition, both the oil galleries 44 and 63 are suppressed from receiving higher oil pressures. Accordingly, both the rocker arm coupling mechanism R and the tappet locking mechanism H keep their inoperative conditions. That is, as is seen from FIG. 4, in the rocker arm coupling mechanism R, the sub-rocker arm 2 is released from the main rocker arm 1, and as is seen from FIG. 6, in the tappet locking mechanism H, the tappet 50 is released from the main rocker arm 1.

Accordingly, the main rocker arm 1 is operated in accordance with the rotation of the lower lift cam 21. Due to this operation of the main rocker arm 1, the intake valve 8 is operated in accordance with the rotation of the lower lift cam 21. However, because the tappet locking mechanism is in the inoperative condition, the pivoting movement of the main rocker arm 1 is not transmitted to the other intake valve 9 causing the same to keep its rest position. That is, the intake valve 9 is kept closed. Accordingly, under the lower speed and lower load condition of the engine, only the intake valve 8 is operated providing only a smaller valve lift thereof. Thus, the flow speed of the intake air fed to the combustion chamber is increased, and thus higher or stronger swirl is obtained in the combustion chamber. Stable and fuel saving combustion is thus obtained even by a lean mixture fed to the engine.

When the engine changes to assume a lower speed and higher load condition (viz., the zone denoted by "II" in FIG. 8), the oil gallery 44 is fed with a higher oil pressure, and thus the sub-rocker arm 2 becomes coupled with the main rocker arm 1 due to energization of the rocker arm coupling mechanism R. Accordingly, the main rocker arm 1 and thus the intake valve 8 become operated in accordance with the rotation of the higher lift cam 22 leaving the other intake valve 9 in the rest condition. Thus, under the lower speed and higher load condition of the engine, only the intake valve 8 is operated providing a larger valve lift thereof. Because the other intake valve 9 is kept closed, a certain swirl is still assured in the combustion chamber. Thus, fuel saving and torque increase in a lower speed are both obtained by a somewhat lean mixture fed to the engine.

When now the engine changes to assume a middle speed condition (viz., the zone denoted by "III" in FIG. 8), the oil gallery 44 is suppressed from receiving the higher oil pressure and the other oil gallery 63 is fed with a higher oil pressure. Thus, upon this, the rocker arm coupling mechanism R becomes inoperative permitting the movement of the sub-rocker arm 2 and the tappet locking mechanism H becomes operative effecting the locked engagement of the tappet 50 with the main rocker arm 1. Accordingly, both the intake valves 8 and 9 are operated by the main rocker arm 1 in accordance with the rotation of the lower lift cam 21. That is, under the middle speed condition of the engine, the two intake valves 8 and 9 are operated while providing a smaller valve lift. Thus, desired air charging efficiency is obtained and thus the middle speed torque is greatly increased by a mixture with a stoichiometric air/fuel ratio. When then the engine changes to assume a higher speed condition (viz., the zone denoted by "IV" in FIG. 8), both the oil galleries 44 and 63 are fed with the higher oil pressures forcing both the rocker arm coupling mechanism R and the tappet locking mechanism H to be operative. Thus, the two intake valves 8 and 9 are operated by the main rocker arm 1 in accordance with the rotation of the higher lift cam 22. Thus, higher air charging efficiency is assured, and thus the high speed torque and the maximum output of the engine are sufficiently increased in this higher speed condition.

Figure 9:
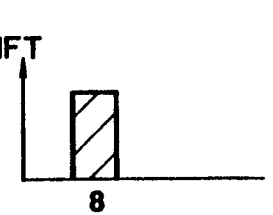
FIG. 9 is a table showing the contents of each controlled condition.
Figure 9:
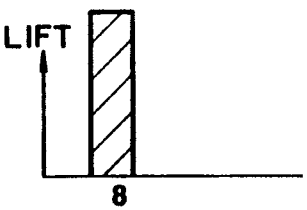
Figure 9:
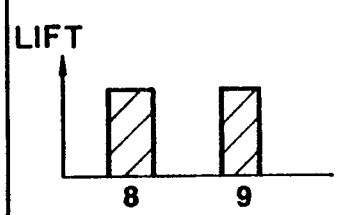
Figure 9:
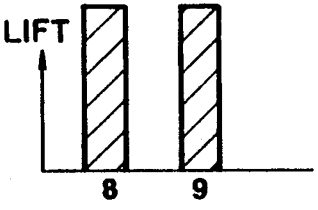

As has been described hereinabove, four valve operation modes can be selectively used in accordance with the operation condition of the engine, which induces both saving of fuel and desired output characteristic of the engine. That is, in accordance with the present invention, satisfied intake efficiency at the higher speed and satisfied swirl in the combustion at the lower speed are both obtained. The detail of the four valve operation modes is shown in the table of FIG. 9.

In the following, a further advantage of the present invention will be described.

The tappet 50 is mounted to the main rocker arm 1 for operating the intake valve 9 which is positioned near the higher lift cam 22. This is important. That is, due to the nature of parts arrangement, the extreme portion of the main rocker arm 1 where the tappet 50 is arranged tends to lose its mechanical strength more than the other extreme portion where the tappet screw 10 is arranged. When, upon the higher speed operation of the engine, the higher lift cam 22 is selected for operating the two intake valves 8 and 9, the load applied to the tappet 50 becomes marked increasing the deflection of the portion per se where the tappet 50 is arranged. Thus, if, unlike the case of the present invention, the piston 50 is arranged at a distance from the higher lift cam 22, the deflection of that extreme portion is much marked due to addition of the deflection of the main rocker arm 1 between the cam 22 and the tappet 50. In the disclosed measure, the tappet 50 is positioned near the higher lift cam 22, and thus the undesired deflection of that extreme portion can be minimized. That is, according to the discosed measure, it is possible to control the deflection of that extreme portion to the level of the other extreme portion where the screw 10 is arranged, which brings about balanced deformations of the two extreme portions of the main rocker arm 1.

Although the above description is directed to the valve operating mechanism applied to the intake valves of internal combustion engine, the mechanism can be also applied to exhaust valves of the engine.

What is claimed is:

1. In an internal combustion engine having at least two intake or exhaust valves for each cylinder, a valve operating mechanism for operating said two valves, which comprises:

first and second cams provided about a common cam shaft;

a main rocker arm which pivots about a rocker shaft in accordance with a rotation of said first cam;

a sub-rocker arm which pivots relative to said main rocker arm in accordance with a rotation of said second cam;

a rocker arm coupling mechanism which, under a given operation condition of the engine, couples tightly said main rocker arm and said sub-rocker arm to cause said main rocker arm to pivot in accordance with the rotation of said second cam;

first and second tappet means held by said main rocker arm to press tops of said two valves in response to the pivoting movement of said main rocker arm, said second tappet means being detachably connected to said main rocker arm so that, under a certain condition, said second tappet means fails to transmit the pivoting movement of said main rocker arm to the associated valve; and a tappet locking mechanism which, under a given operating condition of the engine, locks said second tappet means to said main rocker arm thereby to ensure the transmission of the pivoting movement of said main rocker arm to the associated valve.

2. A valve operating mechanism as claimed in Claim 1, in which said first and second cams are shaped to induce smaller and larger valve lifts respectively.

3. A valve operating mechanism as claimed in claim 2, in which said second tappet means is positioned nearer said second cam than said first cam.

4. A valve operating mechanism as claimed in claim 1, in which said main rocker arm has a roller rotatably mounted thereto, said roller being in contact with a cam profile of said first cam.

5. A valve operating mechanism as claimed in claim 1, in which said sub-rocker arm has a base end which is pivotally connected to said main rocker arm and a free end which is convexly raised and in contact with a cam profile of said second cam.

6. A valve operating mechanism as claimed in claim 5, further comprising a lost-motion spring which is arranged below said sub-rocker arm to bias said convexly raised portion of said sub-rocker arm to contact the cam profile of said second cam.

7. A valve operating mechanism as claimed in claim 6, in which said rocker arm coupling mechanism comprises:

means defining in said main rocker arm first and second aligned bores;

means defining in said sub-rocker arm a third bore, said sub-rocker arm being so arranged that said third bore is sandwiched between said first and second bores;

first, second and third plungers slidably disposed in said first, second and third bores respectively;

means defining in said first bore an oil chamber behind said first plunger; and biasing means for biasing said second plunger toward said third bore, wherein when said oil chamber is filled with a pressurized oil, said first plunger is partially moved into said third bore against the force of said biasing means thereby to achieve a locked engagement between said main and sub-rocker arms and at the same time said third plunger is partially moved into said second bore against the force of said biasing means thereby to achieve a locked engagement between said main and sub-rocker arms.

8. A valve operating mechanism as claimed in claim 7, in which an end of said second bore is covered with a plug, said plug being formed with an air passage through which the interior of said second bore is communicated with the outside air.

9. A valve operating mechanism as claimed in claim 1, in which said second tappet means is a rod-like tappet member which is axially movably put in a bore formed in said main rocker arm.

10. A valve operating mechanism as claimed in claim 9, in which a biasing spring compressed between said rod-like tappet member and said main rocker arm to bias said rod-like tappet member to project toward the top of the associated valve.

11. A valve operating mechanism as claimed in claim 10, in which said tappet locking mechanism comprises:

means defining a fourth bore in said main rocker arm;

means defining a fifth bore in the rod-like tappet member;

fourth and fifth plungers slidably disposed in said fourth and fifth bores respectively; means defining in said fourth bore an oil chamber behind said fourth plunger; and biasing means for biasing said fifth plunger toward said fourth bore, wherein when said oil chamber is filled with a pressurized oil, said fourth plunger is partially moved into said fifth bore against the force of said biasing means thereby to achieve a locked engagement between said rod-like tappet member and said main locker arm.

12. A valve operating mechanism as claimed in claim 1, in which each of said rocker arm coupling mechanism and said tappet locking mechanism comprises:

a hydraulically actuating means powered by a pressurized oil; and means defining in said main rocker arm and said rocker shaft an oil passage, said oil passage having one end connected to said hydraulically actuating means.

13. A valve operating mechanism as claimed in claim 12, in which said means for defining said oil passage comprises:

means defining a first oil passage part in said main rocker arm;

means defining a second oil passage part in said rocker shaft; and means defining a third oil passage part in the portion where said main rocker arm is pivotally connected to said rocker shaft.

14. A valve operating mechanism as claimed in claim 13, in which said means for defining said third oil passage comprises:

means defining an annular groove around a cylindrical wall of said rocker shaft, said annular groove being exposed to said first oil passage; and means defining in said rocker shaft a spurt hole, said spurt hole connecting said annular groove and said second oil passage.

* * * * *